US006863013B2

(12) United States Patent
Noyes, Jr.

(10) Patent No.: US 6,863,013 B2
(45) Date of Patent: Mar. 8, 2005

(54) BOAT PROPULSION SYSTEM

(76) Inventor: Evan L. Noyes, Jr., P.O. Box 368, Cedarville, MI (US) 49719

( * ) Notice: Subject to any disclaimer, the term of this patent is extended or adjusted under 35 U.S.C. 154(b) by 0 days.

(21) Appl. No.: 10/398,490

(22) PCT Filed: Oct. 5, 2001

(86) PCT No.: PCT/US01/31208

§ 371 (c)(1),
(2), (4) Date: Apr. 7, 2003

(87) PCT Pub. No.: WO02/30740

PCT Pub. Date: Apr. 18, 2002

(65) Prior Publication Data

US 2004/0014376 A1 Jan. 22, 2004

Related U.S. Application Data

(60) Provisional application No. 60/274,972, filed on Mar. 12, 2001, and provisional application No. 60/239,669, filed on Oct. 12, 2000.

(51) Int. Cl.[7] ..... B63B 1/22

(52) U.S. Cl. ..... 114/285; 440/69

(58) Field of Search ..... 440/57, 69; 114/271, 114/274, 285, 288, 289, 290

(56) References Cited

U.S. PATENT DOCUMENTS

| | | | | | |
|---|---|---|---|---|---|
| 763,684 | A | * | 6/1904 | Manaker | 440/70 |
| 904,313 | A | * | 11/1908 | Davis | 440/66 |
| 1,059,806 | A | * | 4/1913 | Yarrow | 440/69 |
| 1,227,357 | A | * | 5/1917 | Yarrow | 114/57 |
| 1,543,082 | A | * | 6/1925 | Harley | 440/63 |
| 2,896,565 | A | * | 7/1959 | Stevens | 440/66 |
| 3,440,743 | A | * | 4/1969 | Frederick | 37/342 |
| 3,698,343 | A | * | 10/1972 | Boome | 114/285 |
| 3,707,936 | A | * | 1/1973 | Harris | 114/285 |
| 3,745,963 | A | * | 7/1973 | Fisher | 440/70 |
| 3,763,810 | A | * | 10/1973 | Payne | 114/285 |
| 3,933,116 | A | * | 1/1976 | Adams et al. | 440/57 |
| 3,980,035 | A | * | 9/1976 | Johansson | 440/66 |
| 4,015,556 | A | * | 4/1977 | Bordiga | 440/69 |
| 4,088,091 | A | * | 5/1978 | Smith | 440/69 |
| 4,371,350 | A | * | 2/1983 | Kruppa et al. | 440/69 |
| 4,406,635 | A | * | 9/1983 | Wuhrer | 440/69 |
| 4,689,026 | A | * | 8/1987 | Small | 440/66 |
| 4,713,028 | A | * | 12/1987 | Duff | 440/61 R |
| 4,977,845 | A | * | 12/1990 | Rundquist | 114/289 |
| 5,046,975 | A | * | 9/1991 | Buzzi | 440/66 |
| 5,066,255 | A | * | 11/1991 | Sand | 440/112 |
| 6,045,420 | A | * | 4/2000 | Small et al. | 440/69 |
| 6,138,601 | A | * | 10/2000 | Anderson et al. | 114/285 |
| 6,234,854 | B1 | * | 5/2001 | Rydzewski | 440/57 |

* cited by examiner

*Primary Examiner*—Stephen Avila
(74) *Attorney, Agent, or Firm*—Barnes & Thornburg LLP

(57) ABSTRACT

A boat propulsion system includes a boat having an elongated hull with a water flow channel formed in the bottom thereof, wherein a movable trim plate is disposed within the water flow channel for controlling a flow of water to a surface-piercing propeller which is positioned aft of the water flow channel and which is disposed within a propeller cavity formed in the bottom of the hull. In a fully extended position, the trim plate is flush with the hull of the boat, and in a fully recessed position the trim plate is completely recessed within the water flow channel. The trim plate is variably movable between the recessed and fully extended positions to provide for performance advantages at various boat speeds.

85 Claims, 11 Drawing Sheets

BOAT PROPULSION SYSTEM

CROSS-REFERENCE TO RELATED APPLICATIONS

This application is a U.S. national counterpart application of international application serial no. PCT/US01/31208 filed Oct. 5, 2001, which claims priority to U.S. provisional applications Ser. Nos. 60/239,669 and 60/274,972 filed Oct. 12, 2000, and Mar. 12, 2001, respectively.

FIELD OF THE INVENTION

The present invention relates generally to boat propulsion systems, and more specifically to such systems operable to control the immersion depth of one or more surface-piercing propellers.

BACKGROUND OF THE INVENTION

A variety of systems and apparatus are known for propelling boats. These systems include those disclosed in U.S. Pat. Nos. 763,684 to C. Manaker; U.S. Pat. No. 904,313 to G. Davis; U.S. Pat. No. 1,059,806 to A. Yarrow; U.S. Pat. No. 1,227,357 to H. Yarrow; U.S. Pat. No. 1,543,082 to B. Harley; U.S. Pat. No. 2,896,565 to G. Stevens; U.S. Pat. No. 3,440,743 to G. Divine; U.S. Pat. No. 3,745,963 to W. Fisher; U.S. Pat. No. 3,933,116 to F. Adams et al.; U.S. Pat. No. 3,980,035 to S. Johansson; U.S. Pat. No. 4,015,556 to A. Bordiga; U.S. Pat. No. 4,088,091 to R. Smith; U.S. Pat. No. 4,371,350 to C. Kruppa et al.; U.S. Pat. No. 4,406,635 to W. Wuhrer; U.S. Pat. No. 4,689,026 to M. Small; U.S. Pat. No. 4,713,028 to D. Duff; U.S. Pat. No. 4,977,845 to F. Rundquist; U.S. Pat. No. 5,046,975 to F. Buzzi; and U.S. Pat. No. 5,066,255 to R. Sand, the disclosures of which are hereby expressly incorporated herein by reference.

One particular class of such boat propulsion systems utilizes one or more surface-piercing propellers, typically mounted to a rear portion of the boat and extending downwardly into the body of water in which the boat is immersed. Surface-piercing propellers are often implemented in boat propulsion systems owing to their known ability to provide speed and fuel economy advantages on a planning boat hull. However, it is also known that such propellers do not operate optimally at all speeds, sea conditions, loading and trim, wherein propeller operation is generally affected by each and particularly affected by varying degrees of immersion, which refers to the amount of the propeller which is below the surface of the water.

It is therefore generally understood to be desirable with such boat propulsion systems to control the immersion depth of the one or more propellers such that the one or more propellers is immersed more deeply at low boat speeds, and is conversely immersed less deeply at higher boat speeds such as when the boat planes out. An example of one known propeller drive system 10 for controlling the depth of propeller immersion is illustrated in FIGS. 1 and 2. Propeller drive system 10 includes an articulating propeller drive assembly 12 extending from a rear 14 of a boat 16, and a surface-piercing propeller 18 mounted to an aft end of drive assembly 12. Drive assembly 12 includes a hinge 20, or ball assembly, wherein the immersion depth of propeller 18 may be varied by suitably actuating the hinge to thereby raise or lower the position of the propeller 18 relative to the boat 16 as indicated generally by arrows 22A and 22B. The angular limitations of the ball joint typically require a shaft extension of substantial length to produce an appropriate propeller height adjustment. Such propeller drive systems 10 are known to be used with a single propeller system, such as that illustrated in FIG. 1, or with a multiple propeller system, such as with twin propellers 18A and 18B as shown in FIG. 2. Propeller drive systems of the type illustrated in FIGS. 1 and 2, while generally effective in their intended purpose, are often complicated, expensive, unreliable and prone to mechanical failure. Moreover, such systems are typically difficult to operate and do not lend themselves well to automated control thereof.

Another known group of drive systems incorporates a tunnel in the bottom of the hull in which the propeller is partially or entirely enclosed within the tunnel, and in which some device adjusts the flow of water ahead of the propeller. To date, no such system proved successful in practical application. Surface-piercing propellers need to ventilate; that is, the portion of the propeller above the surface of the water needs to be exposed to atmospheric conditions or their functional equivalent. Existing systems generally lack adequate provision for the propeller to ventilate, or they incorporate complicated ducting arrangements forward of the propeller. Also, while the increased efficiency of a higher gear reduction ratio and associated larger propeller diameter is generally acknowledged, a propeller within a tunnel is size limited by both the hydrodynamic hull performance considerations which limit the cross-sectional area of the tunnel and by the need to maintain adequate propeller tip clearance, which typically may be on the order of 10% of the propeller's diameter.

What is therefore needed is a boat propulsion system that includes one or more operational advantages of the propeller drive system illustrated in FIGS. 1 and 2, but that does not suffer from the drawbacks associated therewith. What is desired, therefore, is a boat propulsion system in which a surface-piercing propeller of relatively unconstrained diameter, and preferably adaptable to disposition under the hull of the boat in plan view, is provided with adequate ventilation, is driven by a fixed, non-articulating shaft, and is variably immersed by means of simple, reliable, and relatively inexpensive components.

SUMMARY OF THE INVENTION

According to one illustrative embodiment of the present disclosure there is presented a boat and propulsion system comprising an elongated hull having a bottom, a forward end and an aft end, an engine carried by the hull, a propeller attached to and driven by the engine, an elongated water flow channel for directing a flow of water to the propeller, wherein the water flow channel is formed in the bottom of the hull and extends from a point forward of the propeller longitudinally forward toward the forward end, and a trim plate disposed within the channel, wherein the trim plate is adjustably movable within the channel to control the amount of water flowing through the channel to the propeller.

According to another illustrative embodiment of the present disclosure there is presented a boat and propulsion system comprising an elongated hull having a bottom, a forward end and an aft end, wherein the hull bottom has a first bottom side in one plane and a second bottom side in a second plane such that the hull bottom is a "V" bottom with the first and second bottom sides meeting at a centerline therebetween and extending generally outwardly away therefrom, an engine carried by the hull, a propeller attached to and driven by the engine, an elongated water flow channel for directing a flow of water to the propeller, wherein the water flow channel is formed in the bottom of the hull and extends from a point forward of the propeller longitudinally forward toward the forward end, and wherein a movable trim plate is disposed relative to the channel to control the amount of water flowing through the channel to the propeller.

According to another illustrative embodiment, a method is presented for controlling the immersion of a surface-piercing propeller connected to and driven by an engine carried by a hull of a boat having a water flow channel formed within a bottom portion of the hull, and including a trim plate disposed within the channel, the method comprising the steps of positioning the trim plate at a first position within the channel when the boat is moving at a first speed; and moving the trim plate from the first position to a second position within the channel when the boat is moving at a second speed greater than the first speed.

DESCRIPTION OF THE PREFERRED EMBODIMENTS

Figure 1:
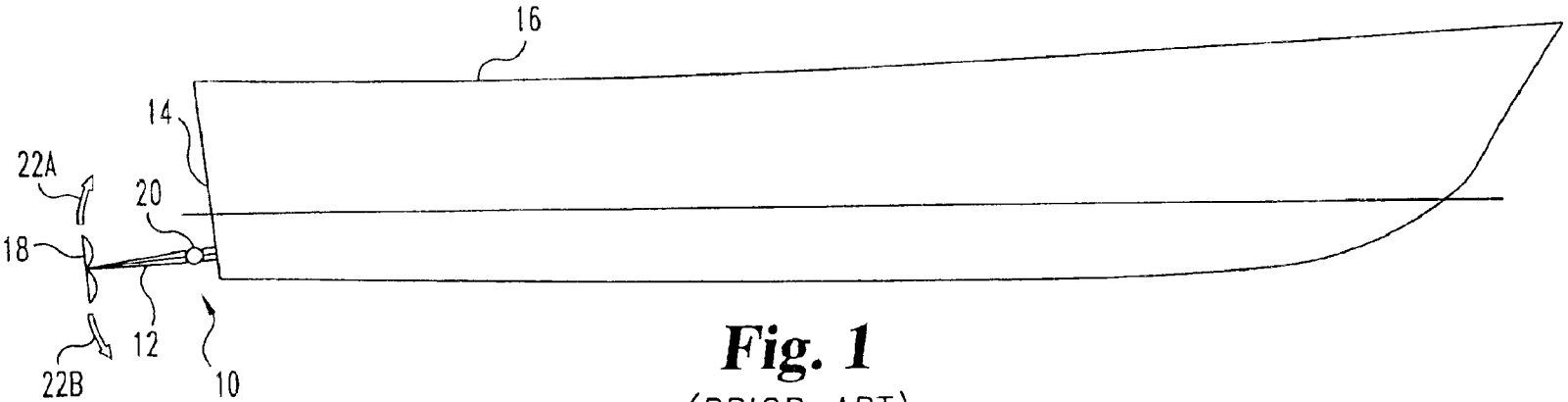
Fig. 1 (PRIOR ART)
FIG. 1 is a side elevation view of a boat including a known boat propulsion system.
Figure 2:
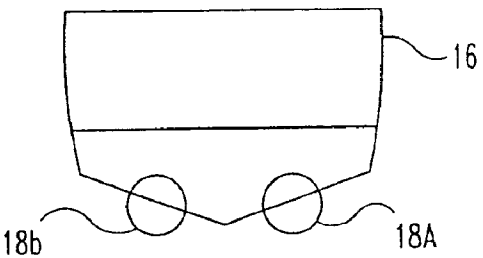
Fig. 2 (PRIOR ART)
FIG. 2 is a rear elevational view of the boat illustrated in FIG. 1 including multiple propellers.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Figure 3:
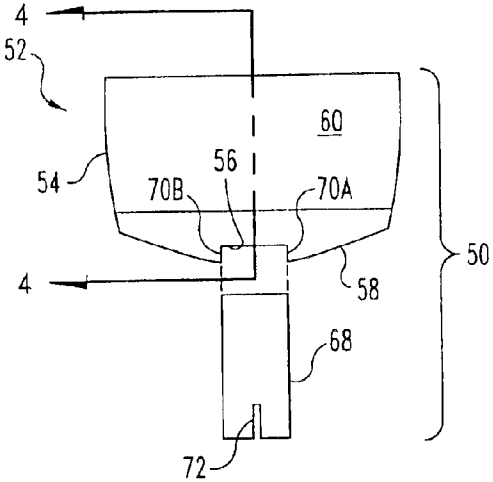
FIG. 3 is a rear elevational view of one preferred embodiment of a boat constructed in accordance with the present invention.
Figure 4:
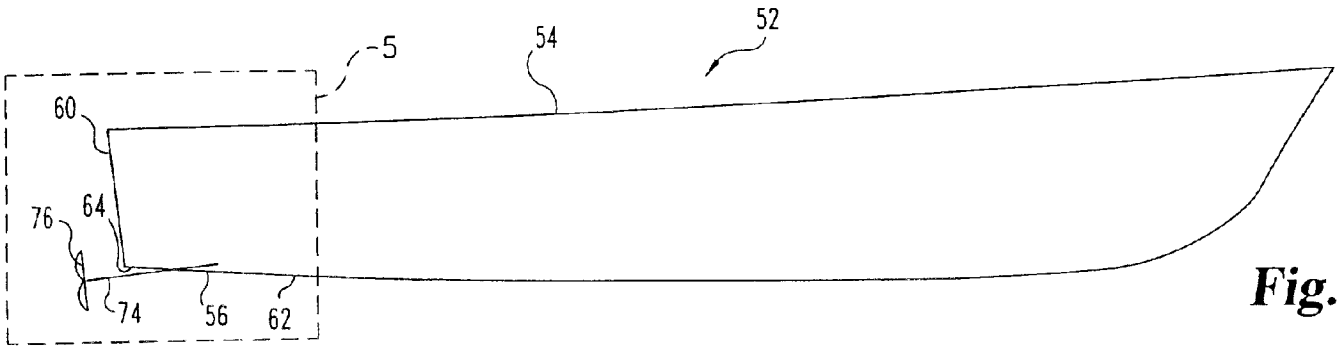
FIG. 4 is a cross-sectional view of the boat of FIG. 3 viewed along section lines 4—4, including additional propeller drive details.
Figure 5:
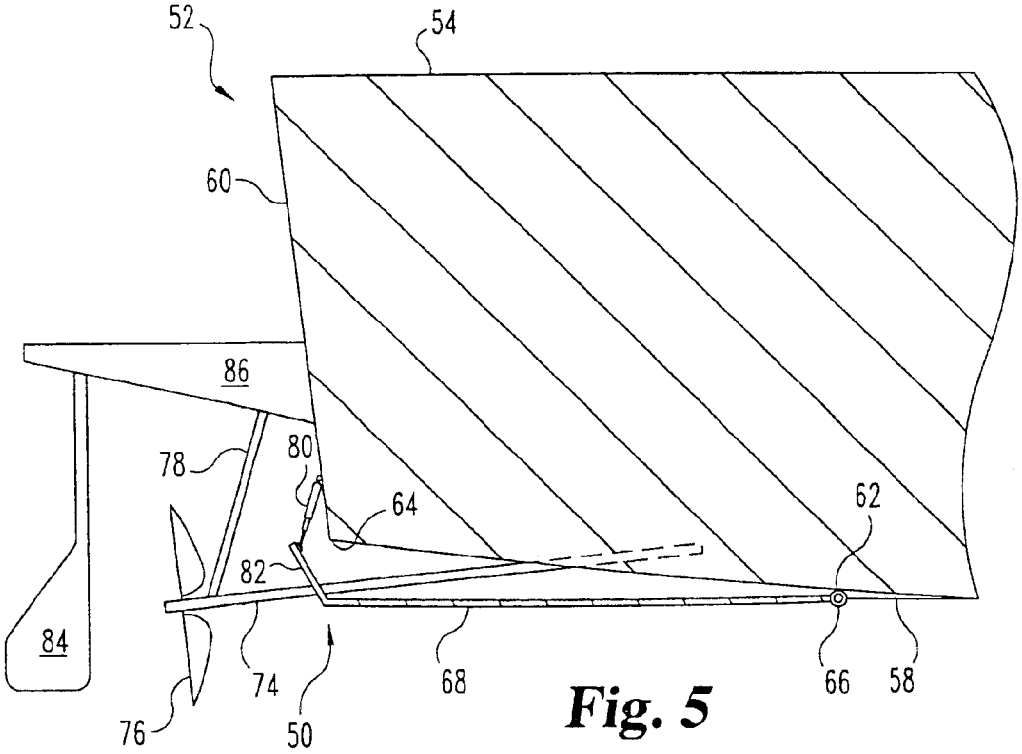
FIG. 5 is a magnified view of the region of the boat of FIG. 4 identified by the dashed-line enclosure, including further details relating to the trim plate assembly.

Referring now to FIGS. 3–6, one preferred embodiment of a boat propulsion system 50, in accordance with the present invention, is shown. System 50 includes a boat 52 having a boat hull 54 which includes at least one open channel 56 inset and formed in a portion of a bottom surface 58 of boat hull 54 and at least a portion of the aft most or rear side 60, generally known as a transom, of boat hull 54. Open channel 56 is generally wedge-shaped or similar trapezoid-shaped in longitudinal profile and rectangular or similar shaped in cross section. Open channel 56 extends into and along bottom surface 58 of hull 54 longitudinally from the rear side 60 of boat hull 54 toward a front side thereof, and has a depth that tapers as the channel extends forwardly from the rear side 60 of hull 54. In other words, channel 56 is generally wedge-shaped such that channel 56 is shallow at its forward end 62 and deeper at its aft end 64, as most clearly shown in FIG. 5. The channel 56 tapers generally linearly from its aft end 64 to its forward end 62 as illustrated in FIGS. 3–5, although the present invention contemplates that the channel may alternatively taper non-linearly or piece-wise linearly from its aft end 64 to its forward end 62.

Pivotably coupled adjacent forward end 62 of channel 56 by a transverse hinge 66 is a trim plate or flow control panel 68 having a configuration in plan view generally identical to the configuration of channel 56 as most clearly shown in FIG. 3. Trim plate 68 is thus rectangular or similar shape which permits trim plate 68 to remain aligned with a pair of spaced-apart side walls 70A and 70B of channel 56. Trim plate 68 is configured to move generally toward and away from channel 56 via hinge 66. Thus, although the illustrative channel 56 tapers, it need not taper as long as there is room in the channel for the trim plate 68 to move within the channel 56.

Trim plate 68 defines a slot 72 therein to permit clearance of a propeller drive shaft 74 through a portion of the range of adjustment of trim plate 68 relative to channel 56. Propeller drive shaft 74 is coupled to at least a portion of boat hull 54 via a strut 78, thereby fixing the position and alignment of propeller drive shaft 74 relative to boat hull 54. A surface-piercing propeller 76 is mounted to the propeller drive shaft 74 at a distal end thereof, aft of the boat hull 54 and trim plate 68. At least a portion of shaft 74 may extend through the slot 72 in the trim plate 68, however, the position of shaft 74 relative to the slot 72 at any time is based upon the position of trim plate 68 relative to the channel 56. The propulsion system 50 of the present invention is thus designed to allow the propeller 76 to be driven by the propeller drive shaft 74 unimpeded by the trim plate 56.

In accordance with the present invention, the immersion depth of the propeller 76 is controlled by the depth of the channel 56 relative to the bottom surface 58 of the boat hull 54, wherein the position of the trim plate 68 relative to the channel 56 defines the depth of the channel 56 relative to the bottom boat surface 58. The trim plate 68 is accordingly adjustable to thereby control the amount of water that may flow through channel 56. This controlled water flow through channel 56 thus allows for optimization of the efficiency of propeller 76 at varying conditions of speed, weight and trim.

In one embodiment, the position of the trim plate 68 relative to the channel 56 is controlled by a hydraulic cylinder 80 or other fluid control mechanism coupled at one end to at least a portion of boat hull 54 and at an opposite end to a plate strut 82, which is in turn coupled to at least a portion of trim plate 68. Hydraulic cylinder 80 and plate strut 82 cooperate to control water flow and degree of immersion of propeller 76 by controlling the position of the trim plate 68 relative to channel 56. It is to be understood, however, that the position of trim plate 68 relative to the channel 56 may alternatively be controlled by other mechanisms including any known combination of mechanical, electrical and fluid components, and any such mechanisms are intended to fall within the scope of the present invention. Some examples of such known mechanisms include, but are not limited to, motor-driven screw arrangements, rack and pinion arrangements, and the like. Other examples of mechanisms for controlling the position of trim plate 68 relative to channel 56, including one or more strategies for actuating such mechanisms, will be described in greater detail hereinafter. In any case, steering of the boat 52 may accomplished through conventional mechanisms therefore, and may be assisted by a conventional outboard rudder 84 mounted to swim platform 86 or similar suitable structure of boat hull 54.

It should now be appreciated that the boat propulsion system 50 of the present invention eliminates the need for propeller drive shaft 74 to articulate or move non-rotatably relative to the boat hull 54 in order to control the degree or depth of immersion of the propeller 76; a characteristic often found in existing arrangements in which a propeller is mounted aft of a boat hull as described hereinabove in the BACKGROUND section. The boat propulsion system 50 of the present invention eliminates this need by providing a boat hull 54 having a bottom surface 58 defining therein a variable depth channel 56, and a trim plate 68 pivotably mounted to the channel 56, wherein the trim plate is adjustably positionable relative to the channel 56 to controllably direct water flow to propeller 76 mounted to drive shaft 74 aft of the channel/trim plate combination, thereby combining the performance advantages of a surface drive propulsion system with the advantages of a straight inboard drive. In addition, the illustrative embodiment is adaptable for use with outboard engines.

Figure 6:
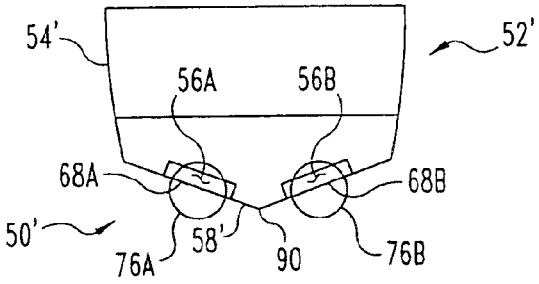
FIG. 6 is a rear-elevational view of a multiple-propeller embodiment of the boat construction concepts illustrated in FIGS. 3–5, in accordance with the present invention.

While the boat propulsion system 50 of the present invention has thus far been described as including only a single propeller/drive shaft combination, it is to be understood that the present invention contemplates implementing the concepts of the present invention in multiple propeller applications. For example, referring to FIG. 6, an alternate embodiment of a boat propulsion system 50 is illustrated and includes a boat 52' having a boat hull 54' defining a V-shaped bottom surface 58'. In this embodiment, the boat propulsion system 50' includes a pair of propellers 76A and 76B, wherein each propeller is positioned aft of a corresponding channel/trim plate combination 56A, 68A and 56B, 68B, respectively on either side of a centerline 90 of the bottom surface 58' of boat 52. It is to be understood that while the boat propulsion system 50' is illustrated in FIG. 6 as including separate propeller/trim plate combinations positioned on either side of the centerline 90 of the V-shaped boat bottom 58', the present invention contemplates providing only a single propeller/trim plate combination positioned on one side of the centerline 90 of the boat bottom 58' or alternatively providing additional propeller/trim plate combinations on either side of the centerline 90.

Figure 7:
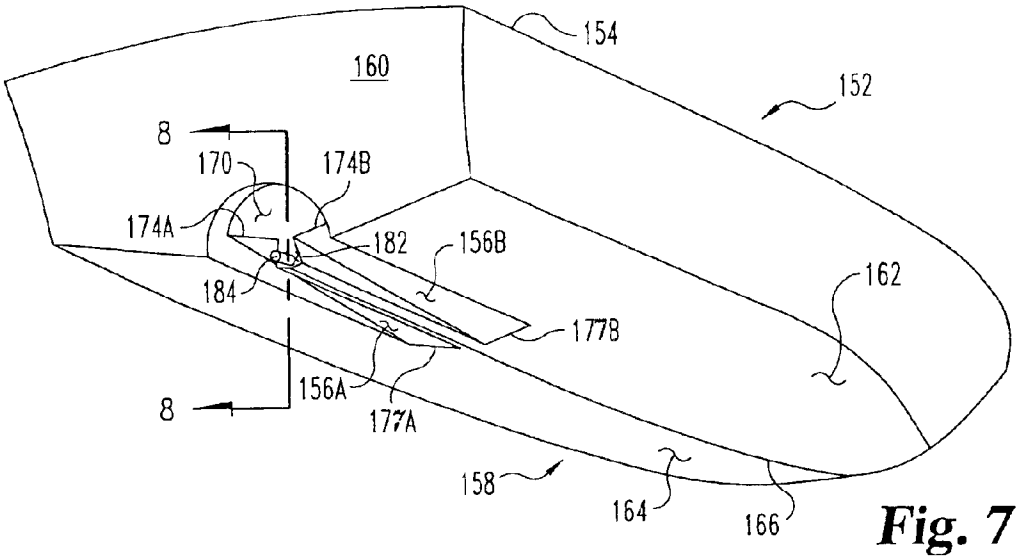
FIG. 7 is a bottom perspective view of another embodiment of a boat constructed in accordance with the present invention.
Figure 8:
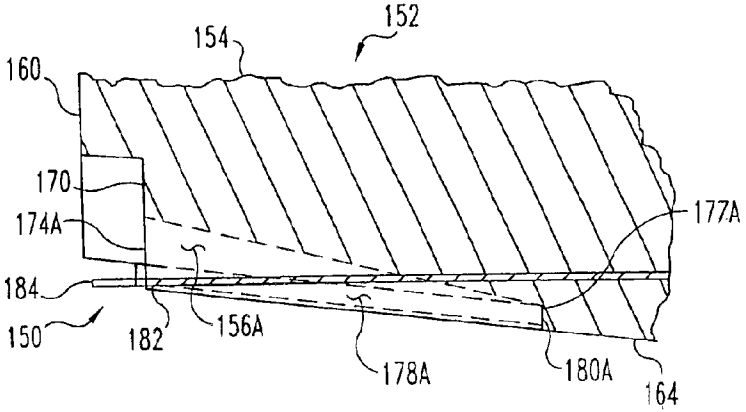
FIG. 8 is a cross-sectional view of the boat of FIG. 7 viewed along section lines 8—8.
Figure 9:
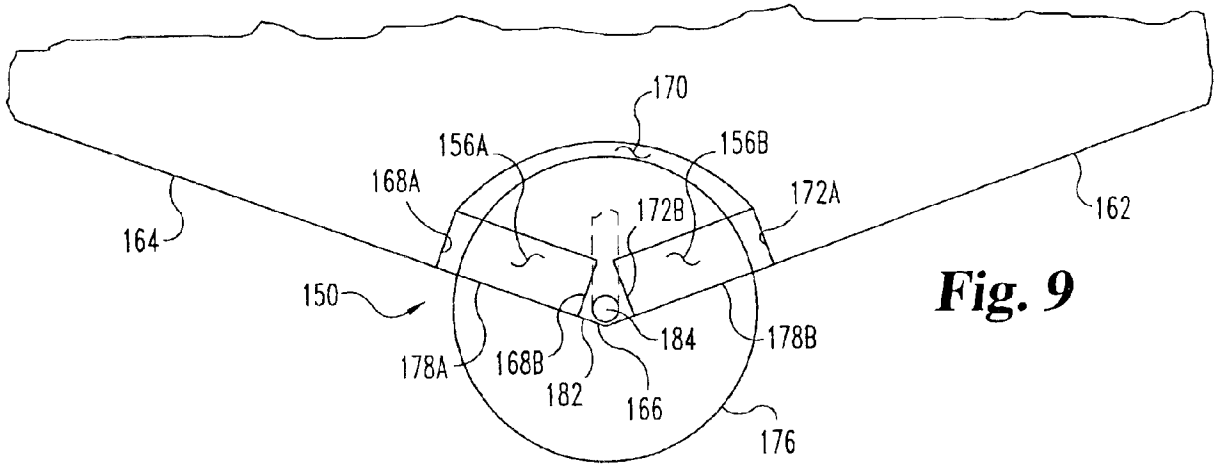
FIG. 9 is a partial rear-elevational view of the boat of FIGS. 7 and 8 having a propeller mounted thereto.

Referring now to FIGS. 7–9, another embodiment of a boat propulsion system 150, in accordance with the present invention, is shown. Boat propulsion system 150 includes a boat 152 having a boat hull 154, wherein hull 154 comprises a bottom surface 158, a rear side 160, and a pair of open channels 156A and 156B inset and formed in a portion of the bottom 158 and of the rear side 160, or transom, of boat hull 154. A generally semi-cylindrical propeller cavity 170 may also be inset and formed in a portion of the bottom 158 and the rear side 160 of hull 154. The bottom surface 158 of boat 152 may be continuous along a single plane, or it may be constructed in more than one plane. For example, in the illustrated embodiment, the bottom surface 158 of boat 152 comprises a first bottom side 162 disposed along a first plane and a second bottom side 164 disposed along a second plane such that bottom side 162 and bottom side 164 generally form a V-shaped construction about a longitudinal centerline 166.

Boat 152 may be equipped with one or more propellers 176. As described hereinabove with respect to the embodiment described with respect to FIGS. 3–6, each of the one or more propellers 176 may have water selectively directed to it by one or more corresponding channels defined in the bottom surface 158 of boat 152. For example, as illustrated in FIG. 9, propeller 176 may have water directed to it by first channel 156A alone, by second channel 156B alone, or by a combination of the first and second channels 156A and 156B. The first channel 156A, which is formed in a portion of first bottom side 164 and a portion of the rear side 160, comprises a pair of spaced apart walls 168A and 168B which are generally perpendicular to the adjacent hull bottom side 164. The second channel 156B, which is formed in a portion of second bottom side 162 and a portion of the rear side 160, comprises another pair of spaced apart walls 172A and 172B which are generally perpendicular to the adjacent hull bottom side 162. Each channel 156A and 156B is generally wedge-shaped or trapezoid-shaped in profile, is generally rectangular or similarly shaped in cross section, is generally tapered in depth extending from the rear side 160 forwardly, and is elongated such that it extends generally longitudinally as shown most clearly in FIGS. 7 and 8. Each channel 156A and 156B has an aft end 174A and 174B respectively and a forward end 177A and 177B respectively, with the aft ends 174A and 174B disposed adjacent to the rear side 160 of boat hull 154. As noted, each channel 156A and 156B is generally wedge-shaped such that it is shallow at its forward end 177A and 177B respectively, and it progressively deepens moving towards its aft end 174A and 174B respectively. Each channel 156A and 156B tapers generally linearly from its aft end 174A and 174B respectively to its forward end 177A and 177B respectively as illustrated in FIGS. 7–9, although the present invention contemplates that channels 156A and 156B may alternatively taper non-linearly or piece-wise linearly from their aft ends 174A and 174B to their forward ends 177A and 177B.

Each channel 156A and 156B has a trim plate 178A and 178B respectively disposed therein and pivotably coupled to the bottom surfaces 164 and 162 respectively adjacent the forward ends 177A and 177B respectively by a transverse hinge 180A and 180B respectively (only hinge 180A shown, although it is to be understood that hinge 180B is located adjacent to the forward end 177B of channel 156B illustrated most clearly in FIG. 7). Each trim plate 178A and 178B has a configuration in plan view generally identical to the configuration of its respective channel 156A and 156B, i.e., generally rectangular shaped or similarly shaped such that trim plate 178A remains aligned with the pair of spaced apart walls 168A and 168B of the channel 156A and trim plate 178B remains aligned with the pair of spaced apart walls 172A and 172B of the channel 156B as shown. Each trim plate 156A and 156B is positioned to pivot about its respective hinge 180A and 180B.

The first channel 156A is laterally spaced apart from the second channel 156B such that channel 156A is formed on bottom side 164 and channel 156B is formed on bottom side 162. The inner wall 168B of channel 156A and the inner wall 172B of channel border a portion of the bottom 158 of boat hull 154 and define therebetween a housing 182 running generally longitudinally down at least a portion of the centerline 166, and containing and enclosing a propeller shaft 184. The propeller shaft 184 extends generally into boat hull 154 as illustrated in FIGS. 7–9, and has a generally fixed alignment relative to boat hull 154. Propeller 176 is mounted to an aft end of propeller shaft 184 and is driven thereby. The propeller 176 is aft of channels 156A and 156B and is at least partially disposed within propeller cavity 170.

Immersion of propeller 176 is controlled by the position of the one or more trim plates 178A and 178B relative to their respective channels 156A and 156B as described hereinabove. Each trim plate 178A and 178B may be selectively positioned alone or in cooperation with any other trim plate, within its respective channel 156A and 156B to provide controlled water flow through the portions of the one or more channels 156A and 156B defined between trim plates 178A and 178B and the respective bottom boat surfaces 164 and 162. This controlled water flow through the channels defined between trim plates 178A and 178B and the respective bottom boat surfaces 164 and 162 allows for optimization of the efficiency of propeller 176 at varying conditions of speed, weight, and trim in the same manner as that described hereinabove with respect to FIGS. 3–6. As noted, propeller 176 is partially disposed within propeller cavity 170 aft of channels 156A and 156B. As each trim plate 178A and/or 178B is adjusted, alone or in cooperation with one or more other trim plates 178A and/or 178B, within its respective channel 156A and/or 156B about pivoting hinge 180A and/or 180B, the depth of the channel defined between either trim plate 178A and 178B and the respective boat bottom 162 and 164 is correspondingly adjusted to thereby control the flow of water within these channels. Although the channels 156A and 156B of the illustrative embodiment have been described as being generally tapered, they need not be so long as the channels are sufficiently deep to accommodate the range of movement of the trim plates 178A and 178B therein. Positioning of either of the trim plates 178A and 187B relative to respective channels 156A and 156B may be accomplished by any conventional electrical, mechanical or hydraulic mechanism, or by combination thereof, as described hereinabove. Some examples of such known mechanisms include, but are not limited to, motor-driven screw arrangements, rack and pinion arrangements, and the like. Other examples of mechanisms for controlling the position of either trim plate 178A or 178B relative to its respective channel 156A or 156B, including one or more strategies for actuating such mechanisms, will be described in greater detail hereinafter. In any case, steering of the boat 152 may accomplished through conventional mechanisms therefore, and may be assisted by a conventional outboard rudder as described hereinabove with respect to FIG. 5, although such a rudder assembly is omitted from FIGS. 7–8 for clarity of illustration.

Figure 11:
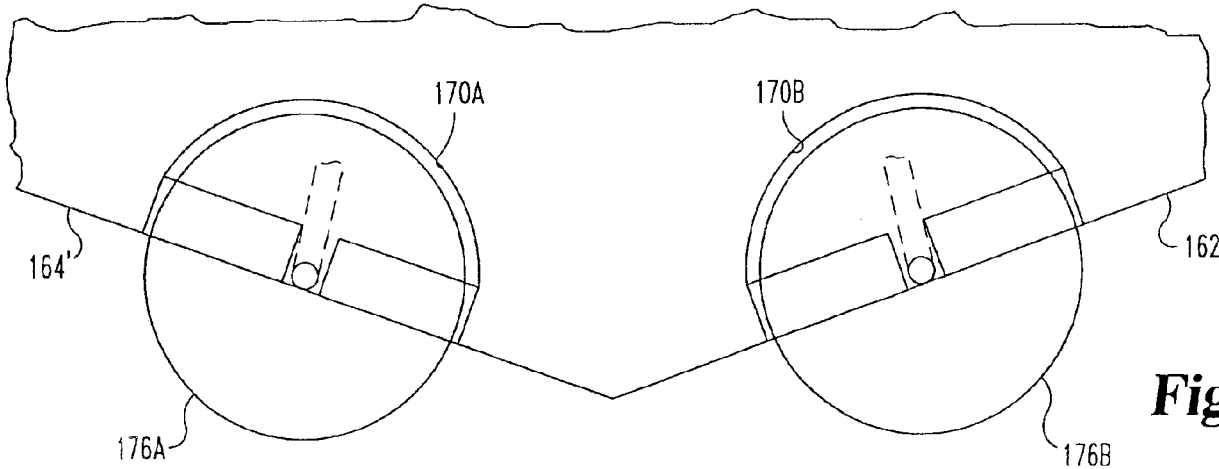
FIG. 11 is a partial rear-elevational view of the boat of FIG. 10 having a pair of propellers mounted thereto.
Figure 10:
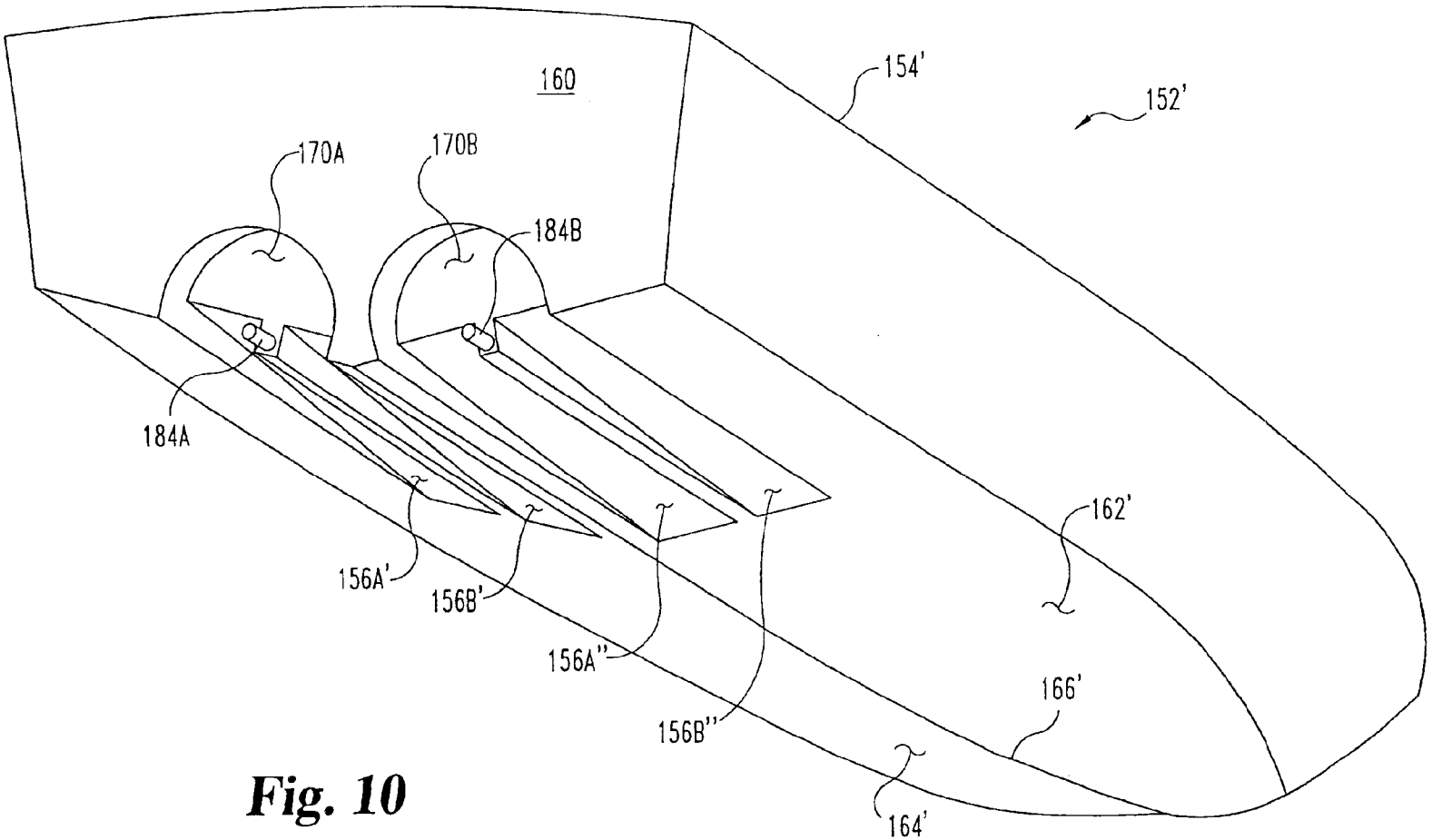
FIG. 10 is a bottom perspective view of another multiple-propeller embodiment of a boat constructed in accordance with the present invention.
Figure 12:
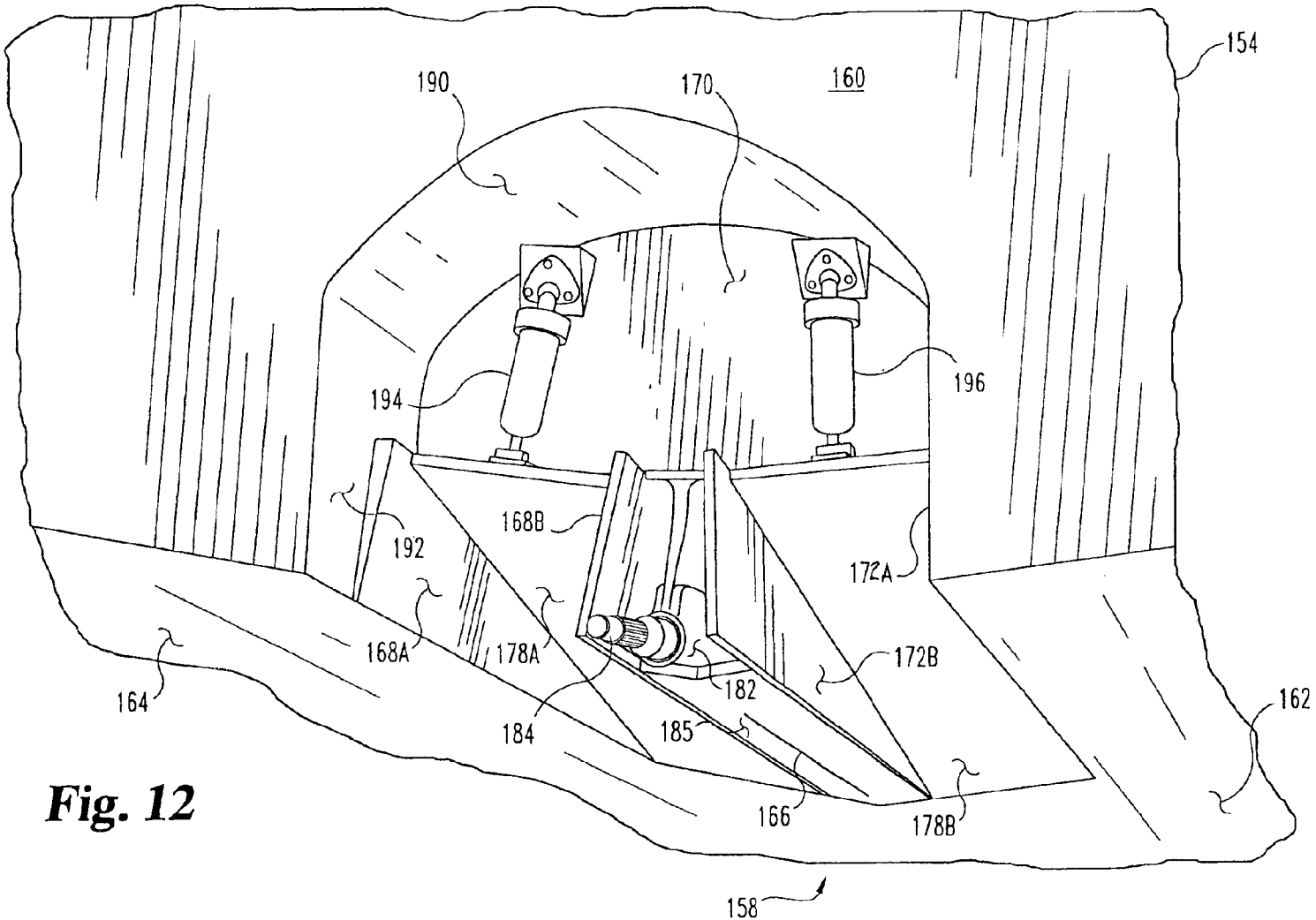
FIG. 12 is a partial rear-elevational view of an illustrative embodiment of the boat of FIGS. 7–9 depicting the trim plates and associated actuating hardware with the trim plates in a retracted position.

While the boat propulsion system 150 of FIGS. 7–9 was described as including only a single propeller/drive shaft combination, it is to be understood that the present invention contemplates implementing the concepts described with respect to FIGS. 7–9 in multiple propeller applications. For example, referring to FIGS. 10–11, an alternate embodiment of a boat propulsion system 150' is illustrated and includes a boat 152' having a boat hull 154' defining a V-shaped bottom surface, wherein the boat hull bottom defines a first bottom surface 162' and a second bottom surface 164' separated by a centerline 166'. In this embodiment, the boat propulsion system 150' includes a pair of propellers 176A and 176B, wherein propeller 176A mounted to a propeller drive shaft 182A and is positioned aft of a pair of channels 156A' and 156B' having a corresponding pair of trim plates 178A' and 178B' disposed therein, and propeller 176B is mounted to a propeller drive shaft 182B and is positioned aft of another pair of channels 156A" and 156B" having a corresponding pair of trim plates 178A" and 178B" disposed therein. It should further be understood that while the boat propulsion system 150' is illustrated in FIGS. 10–11 as including separate propeller/trim plate combinations positioned on either side of the centerline 166' of the V-shaped boat bottom, the present invention contemplates providing only a single propeller/trim plate combination positioned on one side of the centerline 166' of the boat bottom or alternatively providing additional propeller/trim plate combinations on either side of the centerline 166'. It is also appreciated that the illustrative embodiment is adaptable for use with one or more outboard engines.

Referring now to FIGS. 12–15, one preferred embodiment of a mechanism for selectively positioning the one or more trim plates relative to the one or more respective channels defined in the bottom boat surface, in accordance with the present invention, is shown. In FIGS. 12–15, the boat 152 and boat propulsion system 150 shown and described with respect to FIGS. 7–9 is shown implementing one illustrative embodiment of the mechanism for selectively positioning the one or more trim plates, although it should be understood that the illustrated trim plate positioning mechanism may be implemented on any of the boats/boat propulsion system embodiments shown and described herein. While FIGS. 12–15 will be described with some specificity including certain structural dimension information, it will be appreciated that such dimensional information is provided only by way of illustration and example, and that other dimensions and proportions are contemplated and are intended to fall within the scope of the present invention.

In any case, in one illustrative embodiment of the present invention the boat hull 154 has a length of nineteen feet and a beam of seven feet. Such a boat is commercially available as for example the Shamrock 19. Inset and formed in the first side 164 of boat bottom 158 and a portion of the rear side or transom 160 is the first flow channel 156A. Inset and formed in the second side 162 of boat bottom 158 and a portion of transom 160 is the second flow channel 156B.

First flow channel 156A comprises a pair of spaced apart walls 168A and 168B, which extend generally upwardly from and perpendicular to the adjacent first bottom side 164. Second open channel 156B comprises a pair of spaced apart walls 172A and 172B, which extend generally upwardly from and perpendicular to the adjacent second bottom side 162. As described hereinabove, each channel 156A and 156B is generally wedge-shaped or trapezoid-shaped in profile, is generally rectangular or similarly shaped in cross section, is generally tapered in depth, and is elongated such that it extends generally longitudinally forward from the propeller cavity 170 as shown in FIGS. 12–15. In one embodiment, each channel 156A and 156B is forty-four inches in length from aft end 174A and 174B respectively to forward end 177A and 177B respectively (see FIG. 7), and is nine and three-quarters inches wide.

Each flow channel 156A and 156B ends in a propeller cavity 170, which has a generally semi-cylindrical top portion 190 atop a generally rectangular bottom portion 192, and which is inset and formed in a portion of the bottom 158 and the rear side or transom 160. In one embodiment, the rectangular-shaped bottom portion 192 of the propeller cavity 170 is twenty-six inches wide and twelve inches high as measured from the boat bottom 158. The top center of the top portion 190 rises another seven inches above the top of the bottom portion 192 for a total of nineteen inches above the boat bottom 158. The depth of the cavity 170 ranges from ten inches at the top of the channels 156A and 156B to thirteen inches at the top center of the semi-cylindrical top portion 190.

The position of propeller shaft 184 is generally fixed relative to boat hull 154, and extends generally downwardly away from boat hull 154 at an angle. The downward angle of the shaft 184 will be dependent upon various factors known in the art such as optimal propeller-to-hull clearance, which is partially a function of propeller diameter and corresponding power-train gear ratios, and the like. At least a portion of the propeller shaft 184 may extend into the propeller cavity 170. Propeller shaft 184 drives the propeller 176, which is coupled to the aft end of the propeller shaft 184. A representative propeller is commercially available from Hall & Stavert, and with such a propeller, a gear ratio of 2:1 is representative, but may range from 1:1 up to about 3:1. The propeller 176 is aft of channels 156A and 156B and is at least partially disposed within propeller cavity 170. Shaft 184 is connected at its forward end to a marine engine (not shown). While any commercially available marine engine may be used, the Crusader, which is based on a GM 4.3 V-6, is standard on such boats as the Shamrock 19. It will be appreciated that reference to an engine herein is intended to mean a "power train" or the combination of an engine and a transmission.

The propeller shaft 184 is enclosed in a housing 182, wherein housing 182 is defined on its sides by the inner walls 168B and 172B of the channels 156A and 156B respectively, and on its bottom by a generally horizontal center planing surface 185, which is an extension of the bottom 158 extending generally longitudinally down at least a portion of the centerline 166 and extending laterally between and perpendicular to the bottom portions of the sidewalls 168B and 172B. In one embodiment, the housing 182 ranges from about six-and-a-quarter inches wide at the center planing surface 185 to about four-and-three-quarter inches wide at the portion generally even with the top of the channels 156A and 156B.

Each channel 156A and 156B has an associated trim plate 178A and 178B respectively disposed therein and pivotably coupled adjacent the forward ends 177A and 177B by a transverse hinge 180A and 180B (see FIGS. 7 and 8). Each trim plate 178A and 178B has a configuration in plan view generally identical to the configuration of the corresponding channels 156A and 156B such that each trim plate 178A and 178B fits within its corresponding channel 156A and 156B and remains aligned with each pair of spaced apart walls 168A, 168B and 172A and 172B as shown. Accordingly, the trim plates 178A and 178B are, in one embodiment, about forty-four inches long and about nine-and-three-quarter inches wide.

The cooperative movement of the trim plates 178A and 178B within the flow channels 156A and 156B respectively controls the flow of water to the propeller 176 and therefore the degree of immersion of the propeller 176 as described generally hereinabove. Each trim plate 178A or 178B may move, alone or in cooperation with the other trim plate 178A or 178B, within its respective channel 156A or 156B to provide controlled water flow through the portions of the channels 156A and 156B that are open to such water flow by adjustment of the trim plates 178A and 178B. Thus, the propeller 176 may have water directed to it by the first channel 156A alone, by the second channel 156B alone, or by a combination of the first channel 156A and the second channel 156B. This controlled water flow through channels 156A and 156B optimizes the efficiency of propeller 176 at varying conditions of speed, weight, and trim as described hereinabove.

As illustrated and described hereinabove, a position of either trim plate 178A or 178B relative to its corresponding channel 156A or 156B may be adjusted by any conventional mechanical or hydraulic device or combination thereof to thereby define a depth of channel 156A between the trim plate 178A and the first bottom surface 164 and a depth of channel 156B between the trim plate 178B and the second bottom surface 162. In one embodiment, as depicted in FIGS. 12–15, the boat propulsion system includes a first conventional hydraulic cylinder 194 connected at one end to an aft portion of trim plate 178A and at its opposite end to a back wall of propeller cavity 170, and a second conventional hydraulic cylinder 196 connected at one end to an aft portion of trim plate 178B and at its opposite end to a back wall of propeller cavity 170. The positioning of trim plate 178A is thus controlled via selective actuation of cylinder 194, and the positioning of trim plate 178B is controlled by selective actuation of cylinder 196, each in a manner that will be more fully described hereinafter. In one embodiment, each of the cylinders has a total travel of about 3.5 inches between totally retracted and totally extended positions thereof. It will be appreciated, however, that the range of travel of the trim plates 178A and 178B may be varied in other configurations depending upon such factors as the depth of the channels 156A and 156B, the size of the propeller 176 and other factors.

As noted, propeller 176 is partially disposed within propeller cavity 170 aft of channels 156A and 156B. As each trim plate 178A and 178B moves, either alone or in cooperation with the other trim plate 178B or 178A, within its respective channel 156A or 156B by pivoting about hinge 180A and 180B, the depth of the corresponding channels 156A and/or 156B defined between the trim plates 178A and 178B and the bottom sides 164 and 162 respectively is thereby defined. As trim plates 178A and/or 178B move toward the top portion 190 of the propeller cavity 170 under the influence of cylinders 194 and/or 196, thereby increasing the depth of the channels 156A and/or 156B with respect to the bottom surface 158 of boat hull 154, the flow of water therethrough increases, thereby increasing the immersion depth of the propeller 176. Conversely, as trim plates 178A and/or 178B move away from the top portion 190 of the propeller cavity 170 under the influence of cylinders 194 and/or 196, thereby decreasing the depth of the channels 156A and/or 156B with respect to the bottom surface 158 of boat hull 154, the flow of water therethrough decreases, thereby decreasing the immersion depth of the propeller 176. The boat 152 may be steered by any suitable means, including without limitation the conventional rudder 84 depicted in FIG. 5.

It will be appreciated that any of the illustrative embodiments of the present invention may be manufactured with the channels; e.g., channels 156A and 156B, propeller cavity; e.g., propeller cavity 170, and center planing surface; e.g., center planning surface 185 integrally formed into the hull during manufacture of the boat 152. Alternatively, any of the boat propulsion system embodiments illustrated herein; e.g., systems 50, 50', 150, 150', may be retrofitted into existing boats. For example, an appropriate portion of the bottom 158 of a boat 152 may be removed and replaced by a rectangular box spanning the length and width of the cut-out portion grafted into the resulting cut-out area. The size of this box would accommodate the combined length of the channels 156A and 156B and the bottom rectangular portion of the propeller cavity 170. The top portion 190 of the propeller cavity 170 could then be cut out of the transom 160. The channels 156A and 156B and the propeller shaft housing 182 with associated center-planing surface 185 can then be grafted into the large box as sub-assemblies. Such a box and its sub-assemblies can be formed of any desirable material including, but not limited to, any combination of plywood, fiberglass, metal, plastic, or the like.

Figure 13:
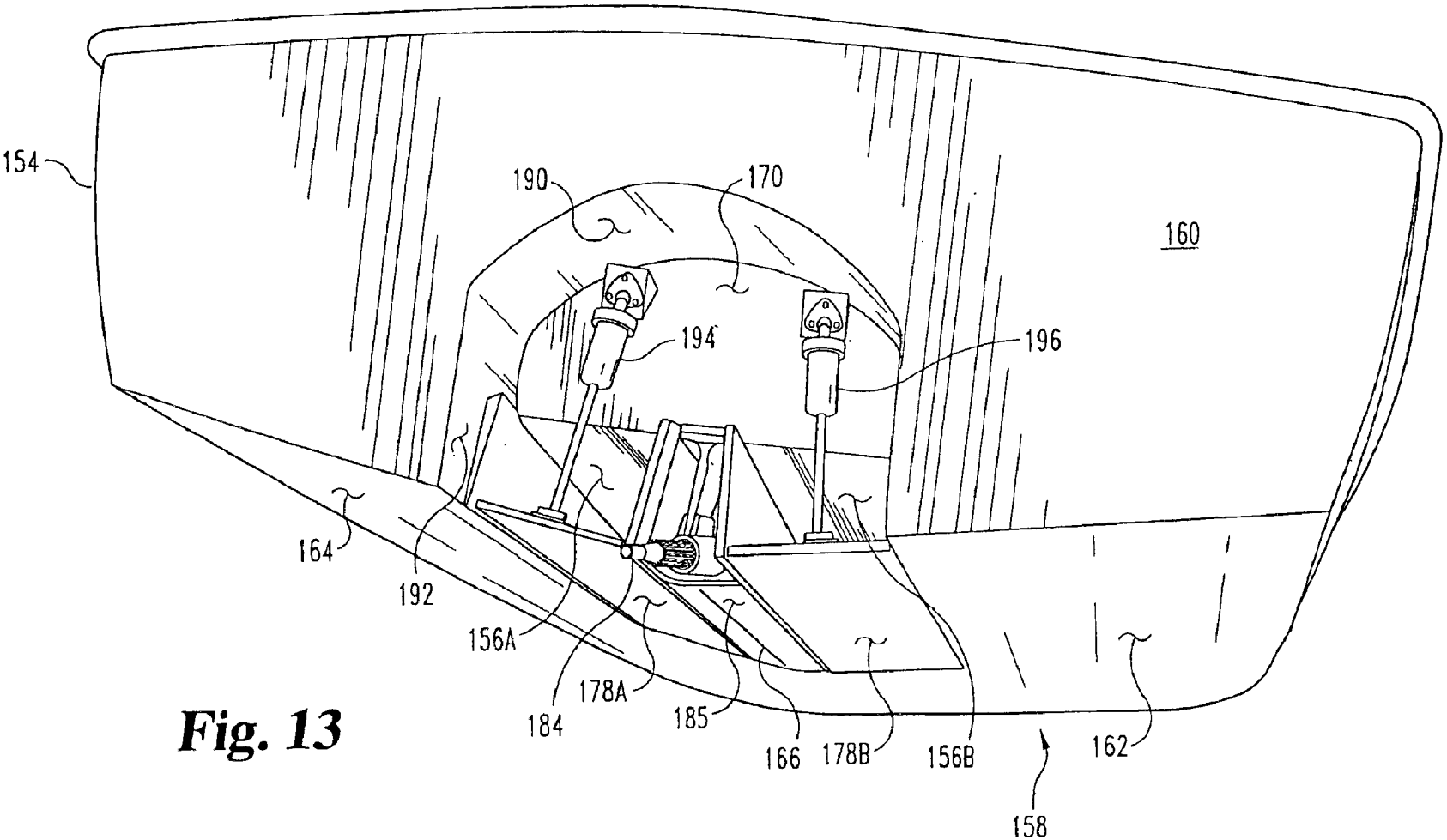
FIG. 13 is a rear-elevational view of the embodiment of FIG. 12 depicting the trim plates in a fully extended position.
Figure 14:
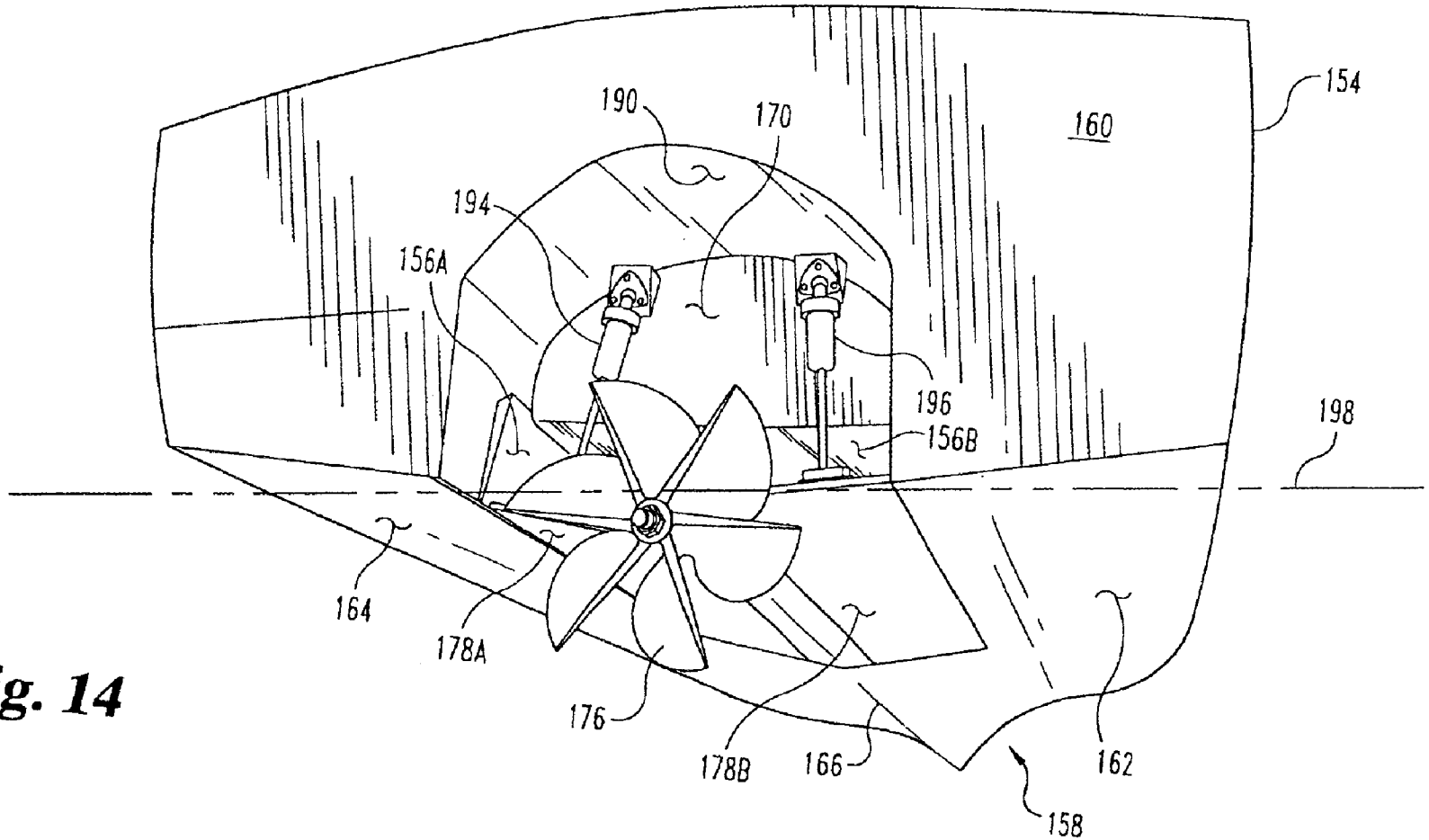
FIG. 14 is a rear-elevational view of the embodiment of FIG. 13 illustrating an example immersion depth of a propeller with the trim plates in a fully extended position.
Figure 15:
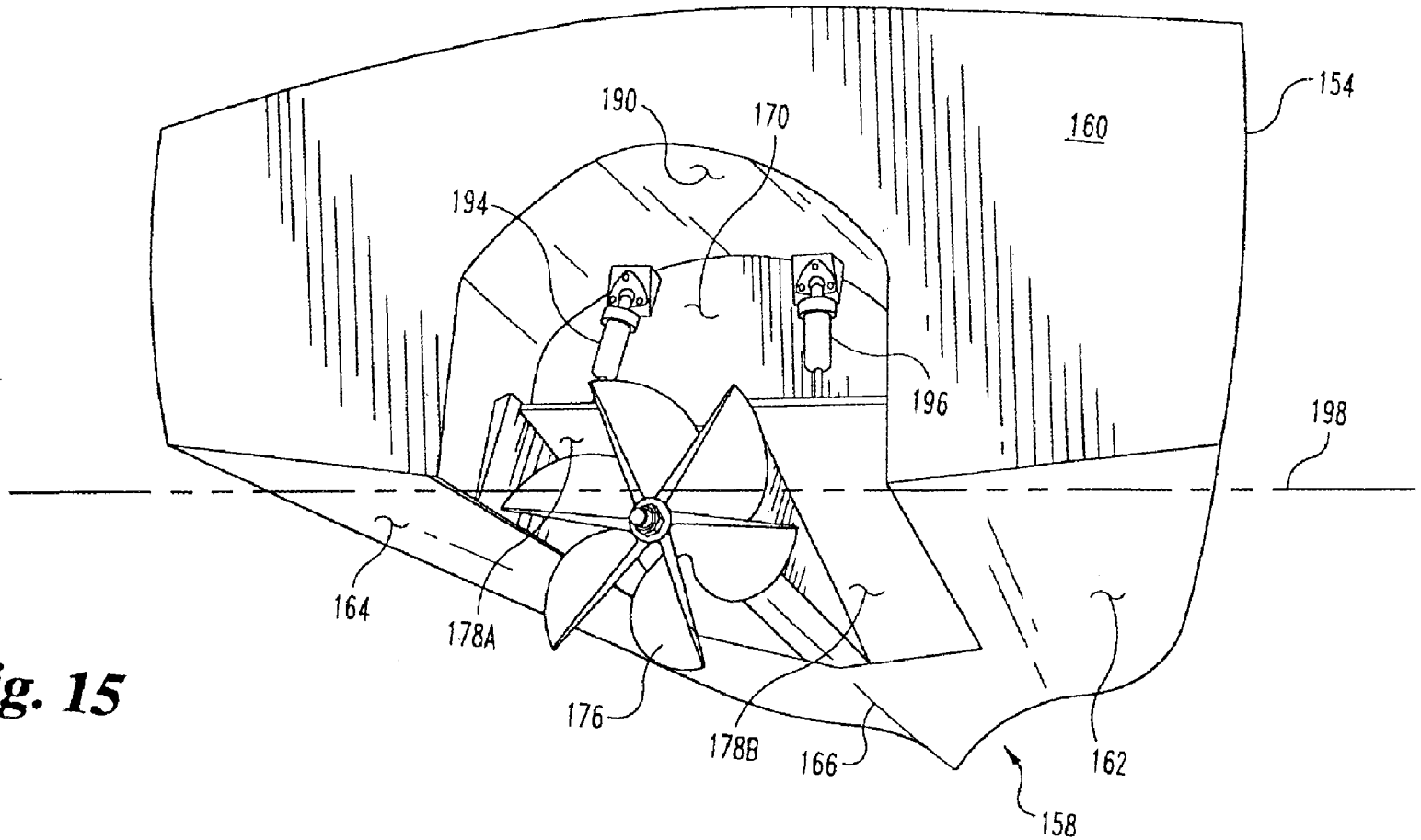
FIG. 15 is a rear-elevational view of the embodiment of FIG. 12 illustrating an example immersion depth of the propeller with the trim plates in a fully retracted position.

Generally speaking, in the fully extended position, the trim plates 178A and 178B will be generally flush with the bottom 158 of the boat hull 154, thereby producing the cleanest hull shape and least amount of drag as illustrated in FIG. 13. This configuration will also allow about half of the propeller 176 at any time, as it rotates through the propeller cavity 170 aft of the channels 156A and 156B, to be free of fluid communication with water as illustrated in FIG. 14, wherein the water line is represented by the dashed line 198. As the trim plates 178A and 178B are retracted up into the channels 156A and 156B toward the top portion 190, progressively more of the propeller 176 is immersed into fluid communication with the water flowing through the channels defined between the trim plates 178A, 178B and the corresponding boat bottom surfaces 164 and 162 respectively. In the fully retracted position, the propeller 176 is fully immersed into the water as illustrated in FIG. 15, wherein the water line is again represented by the dashed line 198.

Figure 16:
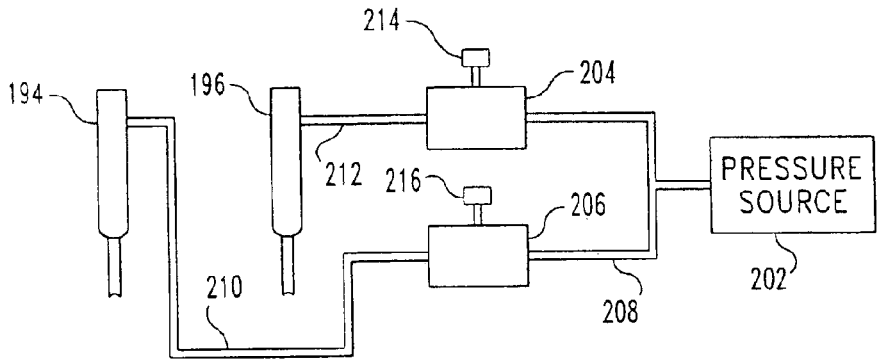
FIG. 16 is a schematic diagram illustrating one preferred embodiment of a trim plate actuation system, in accordance with the present invention.

It will be appreciated that the positioning of the trim plates 178A and 178B relative to channels 156A and 156B respectively may be accomplished via any conventional electrical, mechanical or hydraulic mechanism, or by combination thereof, as described hereinabove. Some examples of such known mechanisms include, but are not limited to, motor-driven screw arrangements, rack and pinion arrangements, and the like. One illustrative example of a hydraulic system 200 for manually controlling the position of trim plates 178A and 178B with respect to corresponding channels 156A and 156B, in accordance with the present invention, is shown in FIG. 16. Referring to FIG. 16, hydraulic system 200 includes a conventional pressure source 202 coupled by a fluid conduit 208 to a first hydraulic control actuator 204 and to a second hydraulic control actuator 206, wherein hydraulic actuators are manually controllable actuators of conventional construction. Hydraulic control actuator 204 is fluidly coupled to hydraulic cylinder 196 via conduit 212 and hydraulic control actuator 206 is fluidly coupled to hydraulic cylinder 194 via conduit 210. Hydraulic control actuator 204 includes a manually controllable lever 214 and hydraulic control actuator 206 includes a manually controllable lever 216. In operation, levers 214 and 216 may be manipulated in known fashion to pressurize and de-pressurize cylinders 196 and 194 respectively to thereby correspondingly extend and retract trim plates 178A, 178B in a manner well-known in the art.

Figure 17:
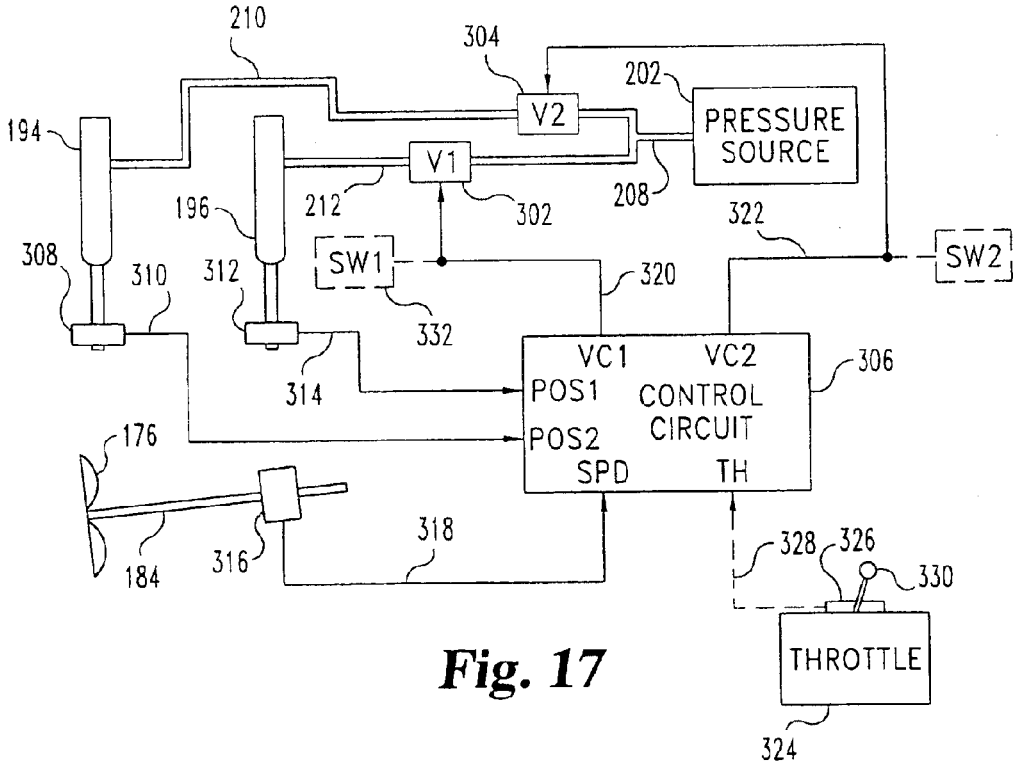
FIG. 17 is a schematic diagram illustrating an alternate embodiment of a trim plate actuation system, in accordance with the present invention.

Another illustrative example of an electrical-hydraulic system 300 for automatically controlling the position of trim plates 178A and 178B with respect to corresponding channels 156A and 156B, in accordance with the present invention, is shown in FIG. 17. Referring to FIG. 17, system 300 includes several components in common with system 200 of FIG. 16, and like components are identified with like reference numbers. For example, a conventional pressure source 202 is coupled by a fluid conduit 208 to a first hydraulic control actuator 302 and to a second hydraulic control actuator 304. Hydraulic control actuator 302 is fluidly coupled to hydraulic cylinder 196 via conduit 212 and hydraulic control actuator 304 is fluidly coupled to hydraulic cylinder 194 via conduit 210. In this embodiment, hydraulic control actuators 302 and 304 are electrically controllable actuators of known construction. In one embodiment, for example, actuators 302 and 304 may be solenoids each responsive to electrical control signals to pressurize and de-pressurize cylinders 194 and 196, in a manner known in the art, to thereby correspondingly extend and retract trim plates 178A, 178B within channels 156A and 156B.

System 300 includes a control circuit 306 for automatically controlling the position of trim plates 178A and 178B, and in one embodiment control circuit 306 is a microprocessor-based control computer of known construction. Alternatively, control circuit 306 may be any known electrical circuit capable of operation as described hereinafter. In any case, system 300 includes first hydraulic cylinder position sensors 308 and 312 electrically connected to position inputs POS1 and POS2 of control circuit 306 via signal paths 310 and 314 respectively. Sensors 308 and 312 may be, for example, calibratable potentiometers each having fixed terminals referenced to an appropriate potential and each having a wiper mechanically coupled to a corresponding hydraulic cylinder 194, 196. As cylinders 194, 196 move under the control of electrical actuators 302 and 304, the voltage on the wipers of the sensor potentiometers correspondingly vary, thereby providing control circuit 306 with information indicative of the position of trim plates 178A and 178B relative to channels 156A and 156B. Those skilled in the art will recognize other known position sensor arrangements for use as sensors 308 and 312, and such other known sensor arrangements are intended to fall within the scope of the present invention.

System 300 further includes a boat speed sensor operable to sense the speed of boat 152 and provide a corresponding boat speed signal to a SPD input of control circuit 306. In one embodiment, for example, a rotational speed sensor 316 of known construction is coupled to propeller drive shaft 184 at an appropriate location, and electrically connected to the SPD input of control circuit 306 via signal path 318. Control circuit 306 is, in turn, operable to process the signal provided by sensor 316 and determine therefrom a traveling speed of boat 152. It will be appreciated that other known boat speed sensor arrangements may be used with system 300, and any such sensor arrangements are intended to fall within the scope of the present invention.

Control circuit 306 further includes a pair of control outputs VC1 and VC2 electrically connected to corresponding electrical actuators 302 and 304 via respective signal paths 320 and 322. Control circuit 306 is configured, in this embodiment, to control the position of hydraulic cylinders 194 and 196, and thus the position of trim plates 178A, 178B relative to channels 156A, 156B, as a function of boat speed in a manner known in the art. For example, control circuit 306 may include a closed-loop control algorithm that determines an appropriate position of each of the cylinders 194 and 196 based on existing position information provided by position sensors 310 and 312 and further based on desired positions therefore as a function of the boat speed signal produced by speed sensor 316, and that controls actuators 302 and/or 304 to position cylinders 194 and 196 at their desired positions.

System 300 may optionally include a throttle position sensor 326 electrically connected to a throttle input TH of control circuit 306 via signal path 328 as shown in phantom in FIG. 17. Throttle position sensor 326 may be of known construction and is operable to sense the position of a throttle lever 330 relative to a throttle base 324, and to provide a corresponding throttle position signal to control circuit 306. In this embodiment, control circuit 306 may be operable to control the position of hydraulic cylinders 194 and 196 as described above and further as a function of the throttle position signal provided by throttle position sensor 326. Alternatively, speed sensor 316 may be omitted, and control circuit 306 may be operable to control the position of cylinders 194 and 196 as a function of current cylinder position and throttle position in a known manner.

System 300 may optionally include a pair of manually controllable switches 332 and 334 of conventional design and electrically connected to electrical actuators 302 and 304 respectively as shown in phantom in FIG. 17. In this embodiment, either of switches 332 and 334 may be manually actuated to override the automatic cylinder positioning control of control circuit 306 and thereby provide for manual control of the position of hydraulic cylinders 194 and 196.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A boat and propulsion system comprising:

an etonaated hull having a bottom, a forward end and an aft end, and including an engine carried by the hull;

a propeller attached to and driven by the engine;

an elongated water flow channel directing a flow of water to the propeller, wherein the water flow channel is formed in the bottom of the hull and extends from a point forward of the propeller longitudinally forward toward the forward end; and a trim plate disposed within the water flow channel and being adjustably movable within the channel to control the amount of water flowing through the channel to the propeller, a drive shaft connecting the propeller to the engine, the drive shaft extending into the water flow channel, and wherein the trim plate has a notch formed therethrough and wherein the drive shaft is configured to extend through said notch.

2. A boat and propulsion system comprising:

an elongated hull having a bottom, a forward end and an aft end, wherein the hull bottom has a first bottom side in a first plane and a second bottom side in a second plane, the first and second bottom sides meeting at a centerline therebetween and extending generally outwardly away therefrom;

an engine carried by the hull;

a propeller attached to and driven by the engine;

a first and a second elongated water flow channel directing a flow of water to the propeller, wherein each of the water flow channels is formed in the bottom of the hull and extends from a point forward of the propeller longitudinally forward toward the forward end; and a trim plate disposed in each of the first and the second water flow channels relative to the respective water flow channel, each trim plate being adjustably movable to control the amount of water flowing through each respective channel to the propeller.

3. The boat and propulsion system of claim 2, wherein the first recited water flow channel is formed in the first bottom side and the second recited water flow channel is formed in the second bottom side, and wherein the propeller is positioned such that it is behind the first and second recited channels and such that its rotational axis is generally between the first and second channels.

4. The boat and propulsion system of claim 3, wherein the first and second trim plates cooperate to control the flow of water to the propeller.

5. The boat and propulsion system of claim 3, wherein the first trim plate operates independently from the second trim plate to control the flow of water to the propeller.

6. The boat and propulsion system of claim 3, further comprising means for controllably varying the position of the first and second trim plates within each flow channel.

7. The boat and propulsion system of claim 3, wherein the propeller is in a fixed orientation to the hull bottom.

8. The boat and propulsion system of claim 7, wherein the propeller is a surface-piercing propeller, and wherein the propeller is positioned aft of the hull.

9. The boat and propulsion system of claim 7, further comprising a propeller cavity adjacent to the channels and extending upwardly into the hull bottom and longitudinally rearwardly toward the aft end of the hull, and wherein the propeller is disposed within the propeller cavity.

10. The boat and propulsion system of claim 7, wherein the propeller is forward of the aft end of the hull.

11. The boat and propulsion system of claim 9, further comprising a second engine carried by the hull, a second propeller driven by the second engine, a second pair of elongated water flow channels each having a trim plate disposed relative thereto in order to control the flow of water to the second propeller, wherein the first recited engine, propeller, pair of water flow channels and trim plates are positioned on the first bottom side and the second recited engine and its associated propeller, water flow channels and trim plates are positioned on the second bottom side.

12. A boat and propulsion system comprising:

a boat having an elongated hull, the hull including a forward end, an aft end, a first bottom side in a first plane, and a second bottom side in a second plane, wherein the first bottom side and the second bottom side meet at a centerline therebetween and proceed outwardly therefrom;

a first water flow channel formed in the first bottom side and a second water flow channel formed in the second bottom side, said first and second channels each comprising a pair of spaced apart walls extending upwardly into the hull bottom wherein each channel is generally rectangular shaped in cross section and extends from the aft end longitudinally forward toward the forward end of the hull;

a propeller cavity formed in the hull bottom, wherein the cavity comprises a pair of spaced apart sidewalls extending upwardly into the bottom of the hull to a further upward extent than the walls of the first and second channels, and wherein the sidewalls extend longitudinally from the aftmost ends of the first and second channels rearwardly toward and through the aft end of the hull;

a first trim plate disposed within the first water flow channel and a second trim plate disposed within the second water flow channel, each trim plate having a transverse hinge at its forward end for connecting the trim plate to the forward end of its respective flow channel and each trim plate being movable about the transverse axis of its hinge, and wherein each trim plate is generally rectangular shaped and has a length and width generally coextensive with the corresponding length and width of its respective channel;

a propeller disposed within the propeller cavity;

a power train carried by the hull;

a drive shaft having a rotational axis fixed relative to the hull and having a forward end and an aft end, wherein the forward end is coupled to the power train and extends rearwardly away therefrom generally downwardly through the hull bottom at the centerline and wherein the shaft's aft end is connected to the propeller;

a first actuator connected to the first trim plate, wherein the first actuator moves the first trim plate up and down in the first channel to control the flow of water to the propeller; and a second actuator connected to the second trim plate, wherein the second actuator moves the second trim plate up and down in the second channel to control the flow of water to the propeller.

13. The boat and propulsion system of claim 12, wherein the trim plates are generally flush with the bottom of the hull when fully extended.

14. The boat and propulsion system of claim 13, further comprising means for controllably varying the position of the first and second trim plates within each respective flow channel.

15. The boat and propulsion system of claim 14, wherein the means for controllably varying the position of each trim plate within its respective flow channel varies the respective position of each trim plate automatically.

16. The boat and propulsion system of claim 15 further comprising a second power train carried by the hull, a second propeller driven by the second power train, a second pair of elongated water flow channels each having a trim plate disposed relative thereto in order to control the flow of water to the second propeller, wherein the first recited power train, propeller, pair of water flow channels and trim plates are positioned on the first bottom side and the second recited power train and its associated propeller, water flow channels and trim plates are positioned on the second bottom side.

17. A boat and propulsion system comprising:

an elongated hull having a bottom, a forward end and an aft end, and including an engine carried by the hull;

a propeller attached to and driven by the engine;

an elongated water flow channel directing a flow of water to the propeller, wherein the water flow channel is formed in the bottom of the hull and extends from a point forward of the propeller longitudinally forward toward the forward end; and a trim plate disposed within the water flow channel, the trim plate having a length and width generally coextensive with the corresponding length and width of the channel, and the trim plate being adjustably movable within the channel to control the amount of water flowing through the channel to the propeller.

18. The boat and propulsion system of claim 17, wherein the flow channel comprises a pair of spaced apart walls extending upwardly into the bottom of the hull and wherein the channel is generally rectangular shaped in cross section.

19. The boat and propulsion system of claim 18 wherein the channel is generally shallower at its forward end and becomes progressively deeper moving toward its aft end.

20. The boat and propulsion system of claim 17 further comprising means for controllably varying the position of the trim plate within the flow channel.

21. The boat and propulsion system of claim 20, wherein the means for controllably varying the position of the trim plate within the flow channel varies the position of the trim plate automatically.

22. The boat and propulsion system of claim 17, wherein the propeller is in a fixed orientation relative to the hull bottom.

23. The boat and propulsion system of claim 17, wherein the propeller is a surface-piercing propeller.

24. The boat and propulsion system of claim 17, wherein the propeller is positioned aft of the hull.

25. The boat and propulsion system of claim 17, wherein the hull has a propeller cavity extending upwardly into the hull bottom and extending from the aft end of the channel longitudinally rearwardly toward the aft end of the hull, and wherein the propeller is disposed within the propeller cavity.

26. The boat and propulsion system of claim 25, wherein the propeller is forward of the aft end of the hull and is fixed in location relative to the hull.

27. The boat and propulsion system of claim 26 wherein a drive shaft connects the propeller to the engine, and wherein the drive shaft extends into the water flow channel.

28. The boat and propulsion system of claim 27 wherein the trim plate has a notch formed therethrough, the drive shaft extending through the notch.

29. The boat and propulsion system of claim 17, further comprising a second water flow channel, the channel having a second trim plate for controlling the flow of water to a second propeller, which is driven by a second engine carried by the hull.

30. The boat and propulsion system at claim 29 further comprising a first drive shaft connecting said first propeller and said first engine and a second drive shaft connecting said second propeller and second engine, wherein said first and second trim plates have a notch formed therethrough and wherein said first and second drive shafts are configured to extend through said respective first and second notches.

31. The boat and propulsion system of claim 30, further comprising a second propeller cavity extending upwardly into the hull bottom and extending from the aft end of the channel longitudinally rearwardly toward the aft end of the hull, and wherein the second propeller is disposed within the second propeller cavity.

32. A boat and propulsion system comprising:

an elongated hull having a bottom, a forward end and an aft end, and including an engine carried by the hull;

a propeller attached to and driven by the engine;

an elongated water flow channel directing a flow of water to the propeller, wherein the water flow channel is formed in the bottom of the hull and extends from a point forward of the propeller longitudinally forward toward the forward end;

a propeller cavity extending upwardly into the hull bottom a greater amount than the deepest portion of the channel and extending from the aft end of the channel longitudinally rearwardly toward the aft end of the hull, and wherein the propeller is disposed within the propeller cavity; and a trim plate disposed within the water flow channel, the trim plate being adjustably movable within the channel to control the amount of water flowing through the channel to the propeller.

33. The boat and propulsion system of claim 32, wherein the flow channel comprises a pair of spaced apart walls extending upwardly into the bottom of the bull and wherein the channel is generally rectangular shaped in cross section.

34. The boat and propulsion system of claim 33, wherein the trim plate is generally rectangular in shape having a length and width generally coextensive with the corresponding length and width of the channel.

35. The boat and propulsion system of claim 32, further comprising means for controllably varying the position of the trim plate within the flow channel.

36. The boat and propulsion system of claim 35, wherein the means for controllably varying the position of the trim plate within the flow channel varies the position of the trim plate automatically.

37. The boat and propulsion system of claim 32, wherein the propeller is in a fixed orientation relative to the hull bottom.

38. The boat and propulsion system of claim 32, wherein the propeller is a surface-piercing propeller.

39. The boat and propulsion system of claim 32, wherein the propeller is positioned aft of the hull.

40. The boat and propulsion system of claim 32, wherein the propeller is forward of the aft end of the hull and is fixed in location relative to the hull.

41. The boat and propulsion system of claim 32 wherein a drive shaft connects the propeller to the engine, and wherein the drive shaft extends into the water flow channel.

42. The boat and propulsion system of claim 41 wherein the trim plate has a notch formed therethrough, the drive shaft extending through the notch.

43. The boat and propulsion system of claim 32, further comprising a second water flow channel, the channel having a second trim plate for controlling the flow of water to a second propeller, which is driven by a second engine carried by the hull.

44. The boat and propulsion system of claim 43 further comprising a first drive shaft connecting said first propeller and said first engine and a second drive shaft connecting said second propeller and second engine, wherein said first and second trim plates have a notch formed therethrough and wherein said first and second drive shafts are configured to extend through said respective first and second notches.

45. The boat and propulsion system of claim 44, further comprising a second propeller cavity extending upwardly into the hull bottom and extending from the aft end of the channel longitudinally rearwardly toward the aft end of the hull, and wherein the second propeller is disposed within the second propeller cavity.

46. A boat and propulsion system comprising:

an elongated hull having a bottom, a forward end and an aft end, wherein the hull bottom has a first bottom side in a first plane and a second bottom side in a second plane, the first and second bottom sides meeting at a centerline therebetween and extending generally outwardly away therefrom;

an engine carried by the hull;

a propeller attached to and driven by the engine;

an elongated water flow channel directing a flow of water to the propeller, wherein the water flow channel is formed in the bottom of the hull and extends from a point forward of the propeller longitudinally forward toward the forward end; and a trim plate disposed relative to the water flow channel, the trim plate having a length and width generally coextensive with the corresponding length and width of the channel, and the trim plate being adjustably movable within the channel to control the amount of water flowing through the channel to the propeller.

47. The boat and propulsion system of claim 46, wherein the flow channel comprises a pair of spaced apart walls extending upwardly into the bottom of the hull and is generally rectangular shaped in cross section.

48. The boat and propulsion system of claim 46, wherein a second elongated water flow channel is formed in the bottom of the hull, the second water flow channel being equipped with a second trim plate adjustably movable to control the flow of water to the propeller.

49. The boat and propulsion system of claim 48, wherein the first recited water flaw channel is formed in the first bottom side and the second water flow channel is formed in the second bottom side, and wherein the propeller is positioned such that it is behind the first and second recited channels and such that its rotational axis is generally between the first and second channels.

50. The boat and propulsion system of claim 49, wherein the first and second trim plates cooperate to control the flow of water to the propeller.

51. The boat and propulsion system of claim 49, wherein the first trim plate operates independently from the second trim plate to control the flow of water to the propeller.

52. The boat and propulsion system of claim 49, further comprising means for controllably varying the position of the first and second trim plates within each flow channel.

53. The boat and propulsion system of claim 52, wherein the means for controllably varying the position of each trim plate within its respective flow channel varies the respective position of each trim plate automatically.

54. The boat and propulsion system of claim 49, wherein the propeller is in a fixed orientation to the hull bottom.

55. The boat and propulsion system of claim 49, wherein the propeller is a surface-piercing propeller.

56. The boat and propulsion system of claim 49, wherein the propeller is positioned aft of the hull.

57. The boat and propulsion system of claim 49, wherein the propeller is forward of the aft end of the hull.

58. The boat and propulsion system of claim 49, further comprising a propeller cavity extending upwardly into the hull bottom and extending longitudinally from the end of the channels rearwardly toward the aft end of the hull, and wherein the propeller is disposed within the propeller cavity.

59. The boat and propulsion system of claim 58 further comprising a second engine carried by the hull, a second propeller driven by the second engine, a second pair of elongated water flow channels each having a trim plate disposed relative thereto in order to control the flow of water to the second propeller, wherein the first recited engine, propeller, pair of water flow channels and trim plates are positioned on the first bottom side and the second recited engine and its associated propeller, water flow channels and trim plates are positioned on the second bottom side.

60. The boat and propulsion system of claim 59, further comprising a second propeller cavity extending upwardly into the hull bottom and extending from the aft end of the channel longitudinally rearwardly toward the aft end of the hull, and wherein the second propeller is disposed within the second propeller cavity.

61. The boat and propulsion system of claim 60, wherein the second recited pair of trim plates each have a length and width generally coextensive with the corresponding length and width of the respective channel in which they are disposed.

62. A boat and propulsion system comprising:

an elongated hull having a bottom, a forward end and an aft end, wherein the hull bottom has a first bottom side in a first plane and a second bottom side in a second plane, the first and second bottom sides meeting at a centerline therebetween and extending generally outwardly away therefrom;

an engine carried by the hull;

a propeller attached to and driven by the engine;

an elongated water flow channel directing a flow of water to the propeller, wherein the water flow channel is formed in the bottom of the hull and extends from a point forward of the propeller longitudinally forward toward the forward end;

a propeller cavity extending upwardly into the hull bottom a greater amount than the deepest portion of the channel and extending from the aft end of the channel longitudinally rearwardly toward the aft end of the hull, and wherein the propeller is disposed within the propeller cavity; and a trim plate disposed relative to the water flow channel, the trim plate being adjustably movable to control the amount of water flowing through the channel to the propeller.

63. The boat and propulsion system of claim 62, wherein the flow channel comprises a pair of spaced apart walls extending upwardly into the bottom of the hull and is generally rectangular shaped in cross section.

64. The boat and propulsion system of claim 62, wherein a second elongated water flow channel is formed in the bottom of the hull, the second water flow channel being equipped with a second trim plate adjustably movable to control the flow of water to the propeller.

65. The boat and propulsion system of claim 64, wherein the first recited water flow channel is formed in the first bottom side and the second water flow channel is formed in the second bottom side, and wherein the propeller is positioned such that it is behind the first and second recited channels and such that its rotational axis is generally between the first and second channels.

66. The boat and propulsion system of claim 65, wherein the first and second trim plates cooperate to control the flow of water to the propeller.

67. The boat and propulsion system of claim 65, wherein the first trim plate operates independently from the second trim plate to control the flow of water to the propeller.

68. The boat and propulsion system of claim 65, further comprising means for controllably varying the position of the first and second trim plates within each flow channel.

69. The boat and propulsion system of claim 68, wherein the means for controllably varying the position of each trim plate within its respective flow channel varies the respective position of each trim plate automatically.

70. The boat and propulsion system of claim 65, wherein the propeller is in a fixed orientation to the hull bottom.

71. The boat and propulsion system of claim 65, wherein the propeller is a surface-piercing propeller.

72. The boat and propulsion system of claim 65, wherein the propeller is positioned aft of the hull.

73. The boat and propulsion system of claim 65, wherein the propeller is forward of the aft end of the hull.

74. The boat and propulsion system of claim 65 further comprising a second engine carried by the hull, a second propeller driven by the second engine, a second pair of elongated water flow channels each having a trim plate disposed relative thereto in order to control the flow of water to the second propeller, wherein the first recited engine, propeller, pair of water flow channels and trim plates are positioned on the first bottom side and the second recited engine and its associated propeller, water flow channels and trim plates are positioned on the second bottom side.

75. The boat and propulsion system of claim 74, further comprising a second propeller cavity extending upwardly into the hull bottom and extending from the aft end of the channel longitudinally rearwardly toward the all end of the hull, and wherein the second propeller is disposed within the second propeller cavity.

76. A method of controlling the immersion of a surface-piercing propeller connected to and driven by an engine carried by a hull of a boat having a water flow channel formed within a bottom portion of the hull, and including a trim plate disposed within the channel comprising the steps of:

positioning the trim plate at a first position within the channel when the boat is moving at a first speed; and moving the trim plate from the first position to a second position within the channel when the boat is moving at a second speed greater than the first speed;

wherein the trim plate is generally disposed within the channel in the first position such that a greater portion of the propeller is immersed in the water relative to the portion of the propeller immersed in the water when the trim plate is in the second position; and wherein the trim plate is extended downwardly toward the bottom of and generally coextensive with the channel in the second position such that a lesser portion of the propeller is immersed in the water relative to the portion of the propeller immersed in the water when the trim plate is in the first position.

77. A method of controlling the immersion of a surface-piercing propeller connected to and driven by an engine carried by a hull of a boat having a water flow channel formed within a bottom portion of the hull, and including a trim plate disposed within the channel comprising the steps of:

disposing the propeller in a propeller cavity extending upwardly into the hull bottom a greater amount than the deepest portion of the channel and extending from the aft end of the channel longitudinally rearwardly toward the aft end of the hull;

positioning the trim plate at a first position within the channel when the boat is moving at a first speed; and moving the trim plate from the first position to a second position within the channel when the boat is moving at a second speed greater than the first speed;

wherein the trim plate is disposed within the channel in the first position such that a greater portion of the propeller is immersed in the water relative to the portion of the propeller immersed in the water when the trim plate is in the second position; and wherein the trim plate is extended downwardly toward the bottom of the channel in the second position such that a lesser portion of the propeller is immersed in the water relative to the portion of the propeller immersed in the water when the trim plate is in the first position.

78. The boat and propulsion system of claim 6, wherein the means for controllably varying the position of each trim plate within its respective flow channel varies the respective position of each trim plate automatically.

79. The boat and propulsion system of claim 10, wherein the propeller comprises a surface-piercing propeller.

80. The boat and propulsion system of claim 11, further comprising a second propeller cavity extending upwardly into the hull bottom and extending from the aft end of the channel longitudinally rearwardly toward the aft end of the hull, and wherein the second propeller is disposed within the second propeller cavity.

81. The boat and propulsion system of claim 12, wherein the propeller comprises a surface piercing propeller.

82. The boat and propulsion system of claim 12, wherein the propeller cavity has a width generally equal to or greater than the combined width of the first and second channels.

83. The boat and propulsion system of claim 12, wherein each of the first and second channels is shallow at its forward end and becomes progressively deeper moving toward its aft end.

84. The boat and propulsion system of claim 16, further comprising a second propeller cavity extending upwardly into the hull bottom and extending from the aft end of the channel longitudinally rearwardly toward the aft end of the hull, and wherein the second propeller is disposed within the second propeller cavity.

85. The boat and propulsion system of claim 18, wherein the channel is shallow at its forward end and becomes progressively deeper moving toward its aft end.

* * * * *